US006491501B1

(12) United States Patent
Wild et al.

(10) Patent No.: US 6,491,501 B1
(45) Date of Patent: Dec. 10, 2002

(54) PROGRESSING CAVITY PUMP SYSTEM FOR TRANSPORTING HIGH-SOLIDS, HIGH-VISCOSITY, DEWATERED MATERIALS

(75) Inventors: Alan G. Wild, Champaign; Charles L. Snyder; Todd E. Brown, both of Springfield; Richard A. Sliwinski, Westerville, all of OH (US)

(73) Assignee: Moyno, Inc., Springfield, OH (US)

( * ) Notice: Subject to any disclaimer, the term of this patent is extended or adjusted under 35 U.S.C. 154(b) by 0 days.

(21) Appl. No.: 09/653,371

(22) Filed: Sep. 1, 2000

(51) Int. Cl.[7] ..... F04B 1/00
(52) U.S. Cl. ..... 417/53; 48/48
(58) Field of Search ..... 417/53, 43, 244; 110/250; 418/48; 366/88; 210/787, 778; 406/46; 405/129; 241/46.02

(56) References Cited

U.S. PATENT DOCUMENTS

| | | | | | |
|---|---|---|---|---|---|
| 3,643,877 | A | * | 2/1972 | Zimmer | 241/46.02 |
| 4,872,954 | A | * | 10/1989 | Hogan | 201/105 |
| 4,961,862 | A | * | 10/1990 | Janecek | 210/778 |
| 4,989,522 | A | * | 2/1991 | Cline et al. | 110/250 |
| 5,015,162 | A | * | 5/1991 | Heppner | 418/48 |
| 5,080,534 | A | * | 1/1992 | Goodson et al. | 406/46 |
| 5,143,481 | A | * | 9/1992 | Schumacher et al. | 405/129 |
| 5,145,256 | A | * | 9/1992 | Wiemers et al. | 366/336 |
| 5,156,751 | A | * | 10/1992 | Miller | 210/787 |
| 5,332,309 | A | * | 7/1994 | Ramazzotti et al. | 366/88 |
| 5,361,797 | A | | 11/1994 | Crow et al. | 137/101.19 |
| 5,479,957 | A | | 1/1996 | Crow et al. | 137/101.9 |
| 5,688,114 | A | * | 11/1997 | Millington et al. | 418/48 |
| 5,782,608 | A | * | 7/1998 | McKee | 417/43 |
| 5,820,354 | A | * | 10/1998 | Wild et al. | 417/244 |
| 5,839,883 | A | | 11/1998 | Schmidt et al. | 417/63 |
| 6,120,267 | A | * | 9/2000 | Cunningham | 418/48 |
| 6,371,206 | B1 | * | 4/2002 | Mills | 166/311 |
| 2001/0000611 | A1 | * | 5/2001 | Cline et al. | 222/1 |
| 2001/0055528 | A1 | * | 12/2001 | Mills | 417/12 |
| 2002/0036175 | A1 | * | 3/2002 | Held | 210/748 |

* cited by examiner

*Primary Examiner*—Teresa Walberg
*Assistant Examiner*—Leonid M Fastovsky
(74) *Attorney, Agent, or Firm*—Thompson Hine LLP

(57) ABSTRACT

A system and method for transporting high-viscosity, high-solids, dewatered materials essentially includes a progressing cavity pump system utilizing a twin-screw feeder with an extended tunnel section. The feeding of the material into an extended tunnel section of the twin screw feeder creates a positive pressure, which assists in feeding the product into the suction housing of the progressing cavity pump, and correspondingly, into the pumping elements. This increases volumetric (fill) efficiency of the progressing cavity pump, thereby allowing a smaller pump to be used. The suction housing of the progressing cavity pump includes an auger positioned therein that is directly coupled to, and preferably integral with, the progressing cavity rotor. The universal joint is moved from the position in front of the stator entrance to a point behind the auger and suction inlet opening to improve flow of material from the suction housing to the progressing cavity pump elements. The inlet conduit coupled to the transition housing is angled slightly towards the direction of flow to further improve the flow efficiency and increase the fill rate of the progressing cavity pump elements. The feeder mechanism of the present system is radially set apart from the progressing cavity elements, where the materials are transported from the extended tunnel section of the feeder to the suction housing of the progressing cavity pump by a transition conduit. In one embodiment, the feeder is positioned above the progressing cavity pumping elements providing a taller system but with a relatively small footprint.

47 Claims, 9 Drawing Sheets

PROGRESSING CAVITY PUMP SYSTEM FOR TRANSPORTING HIGH-SOLIDS, HIGH-VISCOSITY, DEWATERED MATERIALS

BACKGROUND

The present invention relates to a system for transporting high-viscosity materials; and more specifically, an efficient, progressing cavity pump system for transporting high-solids, high-viscosity, dewatered materials, such as dewatered sludge.

Sludge dewatering is one of the fastest growing segments of the municipal wastewater treatment industry. Municipal wastewater treatment plants who have previously placed their waste activated sludge in sludge lagoons or drying beds, or who have previously directly land-applied their waste activated sludge, are now being forced by EPA Section 503 regulations and economics to further process the sludge. Such further processing includes dewatering of the sludge.

EPA Section 503 regulations went into effect in 1993 to establish requirements for the final use and disposal of sewage sludge. These regulations escalated the costs of final disposal of sewage sludge, which in turn gave strong incentive to municipal wastewater treatment plants to reduce the amount of sludge being disposed. The removal of water from the sludge (dewatering) is one of the more practical means to reduce sludge volumes and waste. Therefore, municipal wastewater treatment plants have been using increasing amounts of resources to install or create more efficient dewatering equipment.

Presently, dewatered sewage sludge is transported away from dewatering devices by four different methods: belt conveyors, screw conveyors, piston pumps, and progressing cavity pumps. Pumps have inherent advantages over conveyors. Specifically, the sludge is transported through a pipeline, rather than being exposed to the atmosphere, which significantly reduces odor; sludge can fall off, or be blown off, a conveyor belt, causing a safety and house-cleaning problem; and a dewatered sludge pipeline is easy to heat-trace and insulate as opposed to conveyors, which are not possible to heat-trace or insulate.

In North America, piston pumps comprise a majority of the market share for dewatered sludge pumps. The most common piston pumps utilize a pair of material cylinders in which a corresponding pair of material pistons reciprocate. The sludge material is received at the inlets of each of the material cylinders, the feed into which is controlled by inlet gate tube or poppet valves. Additionally, the flow of the sludge from the material cylinders to an outlet is controlled by outlet poppet valves, respectively. The inlet valves are controlled by hydraulic inlet valve cylinders, and the outlet valves are, likewise, controlled by hydraulic outlet valve cylinders. The material pistons are coupled to hydraulic drive pistons, which are in turn operated according to a hydraulic control system. As the drive pistons and their associated material pistons come to an end of their stroke, one of the material cylinders is discharging material to the outlet, while the other material sender is loading material from the inlet. Accordingly, the inlet and outlet valves are controlled to allow the material to be discharged from the first cylinder and new material to be loaded into the second cylinder. At the next pump cycle, when the second material piston is at the end of its stroke, the inlet and outlet valves will be controlled such that the material is permitted to be discharged from the second cylinder and new material is permitted to be loaded into the first material cylinder. As a result of this design, the material in each cylinder will come to a stop each time a piston reaches the end of its stroke, allowing the inlet and outlet valves to change positions. This material must be then accelerated from a rest condition by a piston on the next stroke. Accordingly, significantly high pressure levels are generated in each of these cylinders during the stroke. Also, significantly high pressure levels are generated in the pipeline to overcome the resulting acceleration losses. Additionally, the resulting flow of materials from the outlet is a pulsating flow. A further disadvantage of the piston-type pumps is that the pumps must be powered by hydraulics and corresponding hydraulic and valve controls, which significantly increase the costs of the pump. Such complexity also increases the costs in maintenance and repairs for the pump systems.

Furthermore, according to federal regulations Section 503, municipal wastewater treatment plants are also required to measure and document the mass flow rate for sludge transport applications. In regard to incinerators, control efficiencies and sludge feed rates have to be reported in mass flow for the proper calculations in determining pollutant limits. A significant disadvantage with the use of the piston-type pump is that the determination of mass flow rate based on volume is complex due to the number of parameters needed for such calculations. For example, a hydraulically-driven piston pump requires two position switches in the hydraulic cylinder to sense the start and stop positions of the piston and to determine the stroke length. A third proximity switch on the discharge valve senses when the valve opens and closes. The piston pump must calculate the volumetric efficiency for each stroke of the pump. The stroke volume is large and even when being fed by a twin screw feeder, the volumetric efficiency could vary a significant amount between strokes, since the inlet valves are an obstruction to suction flow.

The volumetric efficiency is calculated by timing from a startup of the piston stroke to the opening of the valve, and timing from the opening of the valve to the end of the piston stroke when the valve closes. Using time instead of stroke position to determine volumetric efficiency does not compensate for fluctuations in velocity of the piston (i.e., the point where the piston actually goes from no-load to load). Accordingly, typical accuracy for such flow-rate calculation has been found to have a relatively high variance.

Progressing cavity pumps provide an alternative to piston pumps. A progressing cavity pump includes an elongated, externally-threaded rotor rotating within an elongated, internal helical-threaded stator, where the stator has one more lead or start than the rotor. Pumps of this general type are typically built with a rigid metallic rotor and a stator, which is formed from a flexible or resilient material such as rubber. The rotor is made to fit within the stator bore with a compressive fit, which results in seal lines where the rotor and stator contact. These seal lines define or seal off definite cavities bounded by the rotor and stator surfaces. As the rotor turns within the stator, the cavities formed by the seal lines progress from the suction end of the rotor/stator pair to the discharge end of the rotor/stator pair. During one revolution of the rotor, one set of cavities is opened at exactly the same rate that the second set of cavities is closing. This results in a predictable, pulsationless flow.

While such progressing cavity pumps are less expensive and less complicated than the piston pumps, conventional progressing cavity pump systems also have several characteristics that may make them less attractive for use in transporting the high-solids dewatered sludge. Specifically, the volumetric efficiency (filling efficiency) for conventional progressing cavity pumps in such applications can be approximately 50%. Additionally, the footprint of conventional progressing cavity pumps and associated feeders are relatively long and narrow, making it substantially difficult for most municipal wastewater treatment plants to be retrofitted with such systems.

Accordingly, there is a need for a pump system for transporting high-solids, high-viscosity, dewatered materials that is relatively inexpensive and uncomplicated, that has a compact design (footprint), that produces a non-pulsating flow, that has a relatively high volumetric efficiency, that allows for accurate and uncomplicated calculation of mass flow-rate, and that does not necessitate relatively high pressure levels within the system.

SUMMARY

The present invention provides a system and method for transporting high-viscosity, high-solids, dewatered materials. The system essentially comprises a progressing cavity pump system utilizing a twin-screw feeder with an extended tunnel section. The feeding of the material into an extended tunnel section of the twin screw feeder creates a positive pressure, which assists in feeding the product into the suction housing of the progressing cavity pump, and correspondingly, into the pumping elements. This increases volumetric (fill) efficiency of the progressing cavity pump, thereby allowing a smaller pump to be used, and in turn, reducing the expense for the wastewater treatment facility.

The feeder mechanism of the present system is radially set apart from the progressing cavity elements, where the materials are transported from the extended tunnel section of the feeder to the suction housing of the progressing cavity pump by a transition conduit. In one embodiment, the feeder is positioned above the progressing cavity pumping elements providing a taller system but with a relatively small footprint. In another embodiment, the feeder is positioned along side the progressing cavity pumping elements, which reduces the height of the system but increases the width. In yet another embodiment, the feeder is positioned substantially perpendicular to the pump axis. While this embodiment provides the widest footprint, it will also provide the best flow transition of the materials.

The suction housing of the progressing cavity pump includes an auger positioned therein that is directly coupled to, and preferably integral with, the progressing cavity rotor. The universal joint is moved from the position in front of the stator entrance to a point behind the auger and the suction inlet to improve flow of material from the suction housing to the progressing cavity pump elements. The inlet conduit coupled to the transition housing is angled slightly towards the stator entrance to further improve the flow efficiency and increase the fill rate of the progressing cavity pump elements.

Optionally, the system will also include a lubrication injection ring positioned in the discharge section to decrease the friction between the product and the discharge pipe wall. This, in turn, decreases the amount of head pressure that the progressing cavity pump need to develop. The decrease in head pressure allows a smaller pump to be used and also decreases the maintenance time/cost of the system and energy consumed by the system.

The system also utilizes a simplified method that directly measures mass flow rate per revolution of the pump element. The calibration of the unit takes into consideration the volumetric and mechanical efficiency of the progressing cavity pump. Without obstruction of any inlet valves, the volumetric efficiency is constant and repeatable for a progressing cavity pump. With proper operation, mass flow rate calculations for this system will provide increased repeatability and accuracy.

The twin screw feeder of the present system maintains a consistent feed pressure into the progressing cavity pump, and in conjunction with the auger feed rotor in the suction housing of the progressing cavity pump, insures high volumetric efficiency for consistent pumping. The volumetric efficiency is dependent upon pump RPM and solid content, and when sized properly, the progressing cavity pumping elements combined with the twin screw feeder will consistently approach 100% volumetric efficiency.

A large diaphragm pressure sensor positioned in the suction housing of the progressing cavity pump monitors the inlet pressure to the pump. The sensor provides a signal to the feedback control module which then controls the speed of the twin screw feeder to maintain the optimal infeed pressure. A weight sensor in the twin screw feeder provides a signal to the control module, which will adjust the speed of the pump to maintain a constant sludge level in the twin screw feeder. By maintaining a constant amount of sludge in the feeder, the pump flow rate is matched to the rate of the belt press or centrifuge feed feeding the inlet hopper to the twin-screw feeder. A tachometer feedback on the pump drive registers the RPM and total quantity of pump revolutions for the production run. A discharge pressure sensor registers the discharge pressure for consistency indications. Data is also recorded and displayed through the control module.

Accordingly, it is an aspect of the present invention to provide a progressing cavity pump system that comprises: (a) an elongated progressing cavity pump having a suction housing, a discharge port, an elongated progressing cavity stator positioned between the suction housing and the discharge port, and an elongated progressing cavity rotor positioned for rotation within the progressing cavity stator; (b) a feeder having an elongated feeder housing, an inlet, an outlet at a longitudinal end of the feeder housing, and an auger mechanism positioned in the feeder housing for feeding material from the inlet to the outlet, where the elongated feeder housing is positioned radially apart from the elongated progressing cavity pump; and (c) a transfer conduit coupled between the outlet of the feeder and the suction housing of the progressing cavity pump. By positioning the feeder radially apart from the progressing cavity pump, the overall length of the pump system is decreased. This allows more municipal wastewater treatment facilities with limited room for such pumping systems to now utilize the more efficient, more robust, less complicated and less expensive progressing cavity pumps, as opposed to piston pumps.

In certain embodiments, the elongated feeder housing extends substantially parallel to the elongated progressing cavity pump. In one of such embodiments the elongated feeder housing is mounted on the frame extending over the progressing cavity pump, where the inlet of the feeder is an elongated opening extending into the top of the feeder housing, communicating with the hopper positioned above the opening.

It is preferred that the transfer conduit includes an outlet segment directly coupled to the suction housing of the progressing cavity pump and the outlet segment of the transfer conduit is angled at least partially away from the discharge port of the progressing cavity pump, thereby providing a substantially smooth transition for material being pumped from the transfer conduit and through the suction housing of the progressing cavity pump.

It is also preferred that the auger mechanism includes a pair of parallel, intermeshing, counter-rotating augers extending substantially the entire length of the feeder housing cavity, and the inlet to the feeder housing is positioned in the top of the feeder housing and extends from the longitudinal end of the feeder housing opposite the outlet end and to a point substantially distal from the outlet, and providing an extended tunnel section in the feeder approximate the outlet end of the feeder housing. Preferably, the extended tunnel section extends for at least two pitch lengths of the auger conveyor utilized by the auger mechanism. This extended tunnel section promotes a slight build-up pressure at the outlet end of the feeder, which assists in the volumetric efficiency to the progressing cavity pump elements. Additionally, a narrowing preload conduit is positioned between the outlet of the feeder and the suction housing of the progressing cavity pump. This narrowing conduit placed before the progressing cavity pump elements also promotes a pressure increase in the materials being fed, which further assists in the volumetric efficiency to the progressing cavity pump elements.

It is yet another aspect of the present invention to provide progressing cavity pump comprising: (a) an elongated stator housing having a suction end and a discharge end; (b) an elongated progressing cavity stator mounted within the stator housing; (c) an elongated progressing cavity rotor mounted for rotation within the progressing cavity stator, the progressing cavity rotor having a suction end and a discharge end; (d) a suction housing coupled to the stator housing at the suction end of the stator housing, the suction housing including an inlet port; (e) an auger positioned in the suction housing, directly coupled to and integral with the suction end of the progressing cavity rotor, where the auger includes a forward longitudinal end approximate the progressing cavity rotor and a rear longitudinal end distal from the progressing cavity rotor; and (f) a drive shaft extending into the suction housing having a forward longitudinal end and a rear longitudinal end, where the forward longitudinal end of the drive shaft is coupled to the rear longitudinal end of the auger by a universal joint. By moving the universal joint behind the behind the inlet and out of the pumpage in the suction housing, a smoother transition from the auger to the progressing cavity pump elements is provided, thus substantially improving the volumetric efficiency of the progressing cavity pump elements, and, in-turn, the mass flow rate of the system.

Preferably, the inlet port opening is positioned in a radial side wall of the suction housing, where the inlet port opening has a forward edge approximate the forward longitudinal end of the auger and a rear edge approximate the rear longitudinal end of the auger. The universal joint is preferably positioned behind the rear edge of the inlet port opening so that it is positioned substantially out of the flow path of materials through the suction housing. It is also preferred that the auger is fixedly coupled to the progressing cavity rotor and where the progressing cavity rotor has a diameter substantially equal to the diameter of the auger shaft so that a substantially smooth transition is provided from the auger shaft to the rotor. It is also preferred that the inlet conduit feeding the suction housing is angled at least partially rearward with respect to the auger, thereby providing an even smoother transition of material from the inlet conduit and through the suction housing.

It is also preferred that the progressing cavity pump includes a material feeder and fluid communication with the inlet conduit, where the material feeder includes a feeder housing, an inlet, an outlet at an end of the feeder housing, and an auger mechanism positioned in the feeder housing for feeding material from the feeder inlet to the feeder outlet. This feeder housing is preferably positioned radially apart from the suction housing, where the feeder housing may be positioned over top of the progressing cavity pump elements, or on the side of the progressing cavity pump elements to provide the system with a more compact design as discussed above.

It is also preferred that the auger mechanism of the feeder is positioned within an elongated cavity within the feeder housing and the feeder outlet is in fluid communication with an outlet of the elongated cavity; the auger mechanism of the feeder includes a pair of parallel, intermeshing augers positioned with the elongated cavity of the feeder and rotating in opposite directions, where the augers extend substantially the entire length of the elongated cavity within the feeder housing; and that the inlet to the feeder housing is positioned in the top of the feeder housing, radially adjacent to the auger mechanism, and extends from a longitudinal end of the elongated cavity within the feeder housing, opposite the outlet end, to a point substantially distal from the outlet end of the feeder cavity, providing an extended tunnel section within the feeder cavity at the outlet end of the feeder cavity. This tunnel section preferably extends for at least two pitches of the augers extending therethrough. As discussed above, this tunnel section within feeder promotes a pressure increase in the materials being fed to the progressing cavity pump elements, which improves volumetric efficiency.

Furthermore, it is preferred that the progressing cavity pump further includes a drive motor coupled to the rear longitudinal end of the drive shaft and a drive motor housing mounted to the suction housing, where the drive shaft is a hollow drive shaft.

It is yet another aspect of the present invention to provide a progressing cavity pump system that comprises: (a) a feeder mechanism including, (1) a feeder housing having in inlet, an outlet on an end of the feeder housing and an elongated cavity within the feeder housing, where the feeder outlet is in fluid communication with the elongated cavity, and (2) a pair of parallel, intermeshing augers positioned in the elongated cavity and rotating in opposite directions; (b) at least two progressing cavity pumps, each progressing cavity pump including a suction housing, an inlet in the suction housing, a discharge port, an elongated progressing cavity stator positioned between the suction housing and the discharge port, and an elongated progressing cavity rotor positioned for rotation within the progressing cavity stator; and (c) a transfer conduit coupled between the feeder outlet and the suction housing inlet of each of the progressing cavity pumps. This configuration provides controlled and uninterrupted flow of materials to more than one discharge point, such as in a multiple hearth incinerator, where several injection points around the cylindrically shaped furnace results in a controlled bum of the sludge. Other split-flow applications also exist, such as delivering sludge evenly along the length of a tractor trailer.

It is yet another aspect of the present invention to provide a method for transporting high-solids, dewatered materials that comprises the steps of: (a) introducing the materials into a hopper; (b) depositing the materials from the hopper to a pair of intermeshing, counter rotating augers in a feeder; (c) conveying the materials, by the augers, to an enclosed chamber (enclosed on all radial sides) within the feeder cavity; (d) generating a predetermined pressure increase in the enclosed chamber; (e) transporting the materials from the enclosed chamber to a suction port of a progressing cavity pump; and (f) pumping the materials, by the progressing cavity pump, to a discharge outlet.

Preferably, the conveying, transporting and pumping steps occur continuously, thereby, not allowing the material to stop moving between the feeder and the desired outlet. It is also preferred that the method includes the step of positioning the feeder in a location radially set apart from the progressing cavity pump. It is also preferred that the method further includes the steps of sensing the pressure of the material approximate the suction port of the progressing cavity pump, and controlling the speed of the feeder augers according to the pressure sensor reading. It is also preferred that the method includes the steps of sensing the amount of material present in the feeder cavity, and controlling the speed of the pump according to this reading. Preferably, the amount of material in the feeder cavity is sensed by a weight (or load) sensor in the feeder.

The method may also include the steps of positioning a lubrication source in a discharge section of the progressing cavity pump, and injecting lubrication, by the lubrication source, between the materials in the discharge section and the discharge section conduits. Preferably, these steps further include the step of sensing a pressure in the discharge section, and controlling the amount of lubrication injected by the lubrication source according to the pressure sensed in the discharge section.

It is yet another aspect of the present invention to provide a method for transporting high-solids, dewatered materials that comprises the steps of: (a) transporting the materials from a feeder to a suction port of a progressing cavity pump, the feeder having a feeder cavity and a feed mechanism positioned within the feeder cavity; (b) pumping the materials, by the progressing cavity pump, to a discharge outlet; (c) sensing a pressure of the material in a material path approximate the suction port of the progressing cavity pump; (d) controlling the speed of the feed mechanism according to the pressure sensed in step (c); (e) sensing an amount of material present in the feeder cavity; and (f) controlling the speed of the progressing cavity pump according to the amount of material present in the cavity as sensed in step (e). Preferably, the sensing step (e) includes the step of sensing a weight of the material in the feeder cavity.

Accordingly, it is an object of the present invention to provide a pump system for transporting high-solids, dewatered materials that is relatively inexpensive and uncomplicated, that has a compact design (footprint), that produces a non-pulsating flow, that allows for accurate and un-complicated calculation of mass flow-rate, and that does not necessitate relatively high flow pressures within the system. These and other objects and advantages of the present invention will be apparent from the following description, the appended claims and the attached drawings.

BRIEF DESCRIPTION OF THE DRAWINGS

FIG. 7B is a schematic block diagram of a control system according to an embodiment the invention.

DETAILED DESCRIPTION

Figure 1:
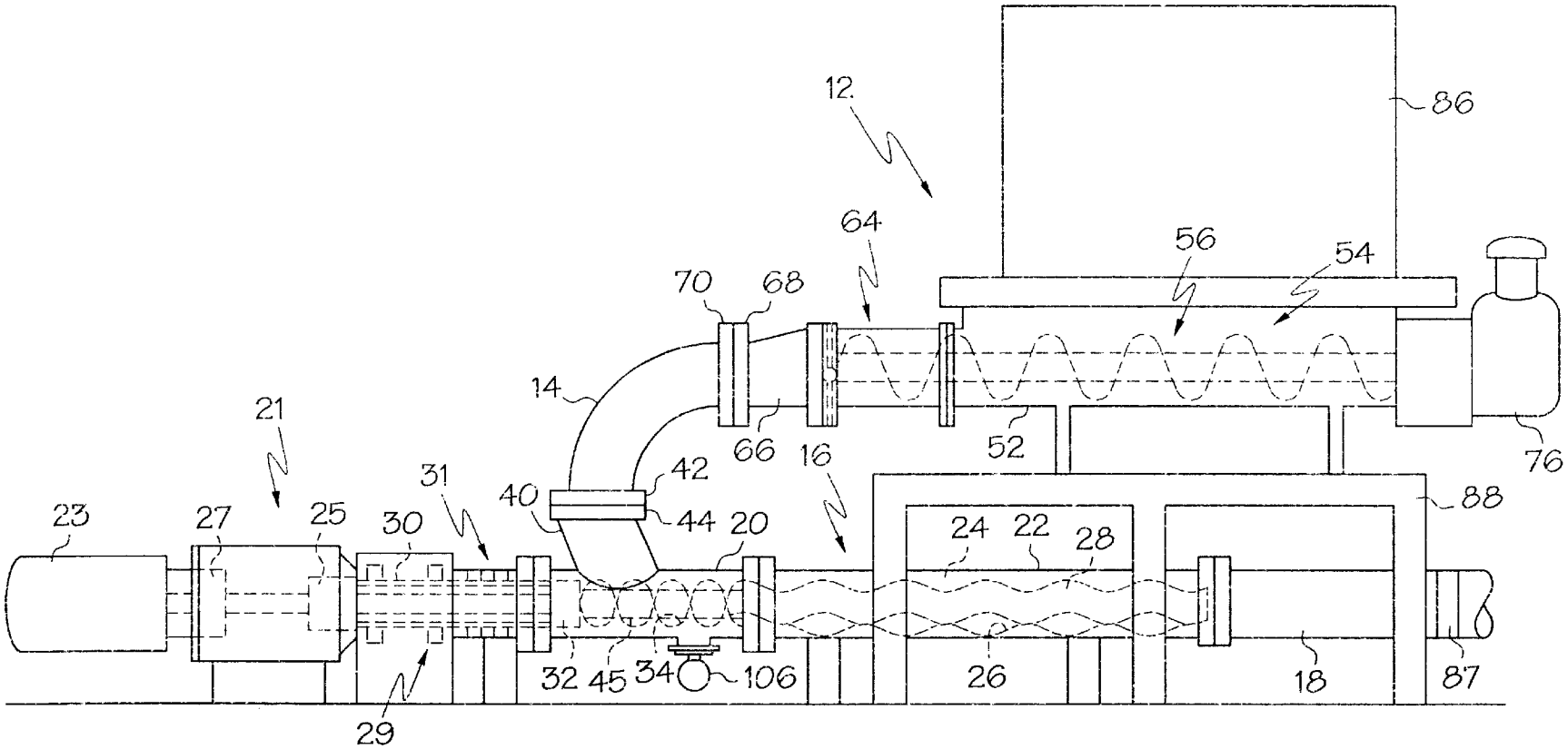
FIG. 1 is a schematic, elevational view of a first embodiment of the progressing cavity pump system according to the invention.

As shown in FIG. 1, a first embodiment of the present invention includes a feeder mechanism 12 for receiving the high-viscosity, high-solids, dewatered materials (such as dewatered sludge) from a dewatering station and for feeding the dewatered materials through a transition conduit 14 to a progressing cavity pump 16, where the progressing cavity pump pumps the dewatered materials to discharge piping 18. The progressing cavity pump includes a suction housing 20 and a stator housing 22. Mounted within the stator housing 22 is a progressing cavity stator 24 having an internal bore 26 extending longitudinally therethrough in the form of a double-lead helical nut. Within the stator bore 26 is positioned a progressing cavity rotor 28, which is in the form of a single-lead helical screw. The progressing cavity stator 24, fixed within the stator housing 22, is preferably formed from resilient and flexible elastomeric material, and the progressing cavity rotor 28 is preferably metallic and rotates eccentrically inside the stator bore 26. The progressing cavity rotor 28 is driven by a hollow drive shaft 30 which is coupled to the progressing cavity rotor 28 by a front universal joint 32 and an auger 34 positioned within the suction housing 20. The drive section 21 of the progressing cavity pump 16 includes a drive motor 23 coupled to the hollow drive shaft 30 by a back universal joint 25. The drive section 21 also includes a coupling 27, bearings 29 and packing 31 of conventional design. For additional information on the operation and construction of progressing cavity pumps and their associated drive sections, reference can be made to U.S. Pat. Nos. 2,512,764 and 2,612,845, and to Moyno® 2000 Series or Moyno® 1000 Series PCP Systems, commercially available from Moyno, Inc., Springfield, Ohio.

Figure 2:
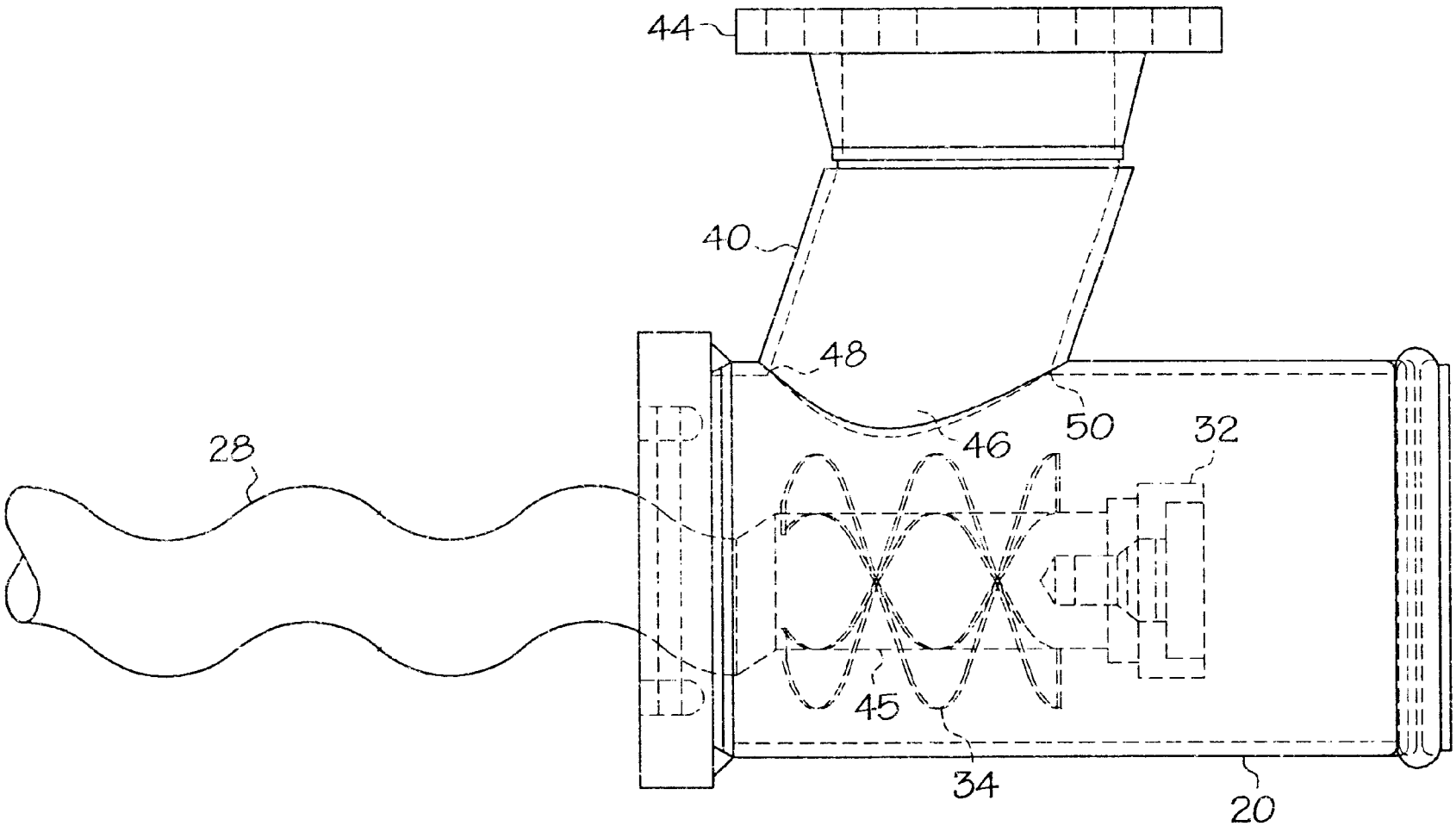
FIG. 2 is a schematic view of the suction housing for the progressing cavity pump according to a preferred embodiment of the present invention, showing certain internal components in phantom.

Referring to FIGS. 1 and 2, an inlet conduit 40 extends from the suction housing 20 and is coupled to the transition conduit 14 by a pair of flanges 42, 44. The auger 34 includes an auger shaft 45 having a diameter that is substantially equal to the diameter of the progressing cavity rotor 28. Furthermore, the auger shaft 45 is directly coupled to, and is substantially integral with the progressing cavity rotor 28 so as to provide a substantially smooth transition between the auger shaft 45 and the progressing cavity rotor 28. The universal joint 32 is moved rearward within the suction housing 20 to the longitudinal end of the auger shaft 45 opposite that of the progressing cavity rotor 28. This positioning of the universal joint 32 within the suction housing 20 moves the universal joint 32 to a position where it will not appreciably block the flow of dewatered materials passing through the suction housing to the progressing cavity pump elements 24, 28. Additionally, the relatively smooth transition from the auger shaft 45 to the progressing cavity rotor 28 further assists in allowing for a smooth flow of the dewatered materials.

The opening 46 into the suction housing from the inlet conduit 40 is positioned over the auger 34 such that the front edge of the opening 48 is substantially approximate the front end of the auger so that the rear edge 50 of the opening is substantially approximate the rear longitudinal end of the auger. The inlet conduit 40 is preferably angled slightly away from the forward end (the end approximate the progressing cavity rotor 28) of the auger 34 to provide a smoother transition of the materials from the inlet conduit 40 through the suction housing 20 to the progressing cavity pump elements 28, 24.

Figure 3:
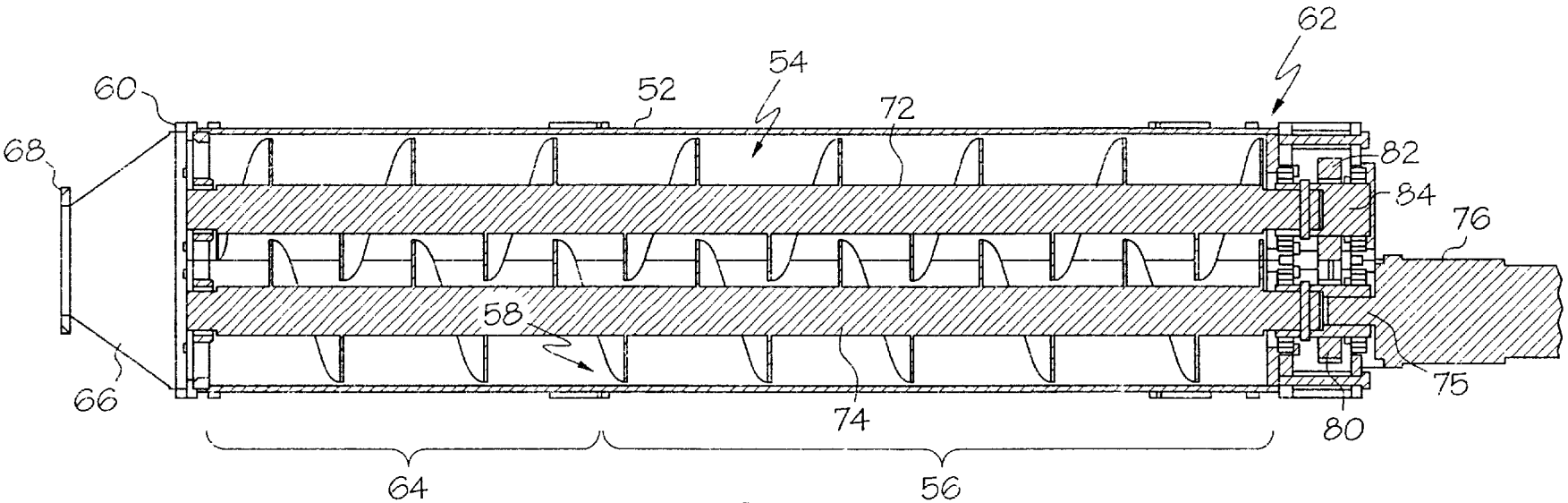
FIG. 3 is a cross-sectional view of the feeder according to a preferred embodiment of the present invention, taken along lines 3—3 in FIG. 1.

Referring to FIGS. 1 and 3, the feeder 12 includes an elongated feeder housing 52 having an elongated internal feeder cavity 54. The feeder housing 52 includes a hopper section 56, which has a longitudinally extending open top for receiving the dewatered materials therethrough, and a pressure generating section 64, which is enclosed on all radial sides (i.e., having a closed top). The pressure generating section 64 preferably extends for at least two pitch lengths of the auger(s) in the feeder cavity 54. The feeder cavity 54 extends through both the hopper section 56 and pressure generating section 64 of the feeder housing 52. Preferably the top opening in the hopper section 56 extends from an outlet end 58 of the hopper section (which is preferably substantially distal from an outlet end 60 of the housing 52) to an opposite longitudinal end 62 of the hopper section 56 (which is preferably the longitudinal end of the feeder cavity 54). The outlet end 60 of the pressure generating section 64 is open to provide an outlet from the feeder 12. Coupled to the outlet end 60 of the pressure generating section 64 is a narrowing preload conduit 66, the inner dimensions of which narrow with the distance from the outlet end 60 of the feeder housing, The preload conduit 66 includes a connecting flange 68 for coupling to the connection flange 70 of the transition conduit 14.

The tubular housing of the pressure generating section 64 of the feeder housing 52 is removably coupled between the hopper section 56 of the feeder housing 52 and the preload conduit 66. Accordingly, the tubular housing may be easily detached and machined and/or reconditioned to the precise tolerances required for the efficient operation of the feeder 12.

Within the feeder housing is provided a twin-screw auger mechanism of conventional design, utilizing a right-hand auger 72 and a left-hand auger 74, intermeshing with each other and driven for counter rotation within the feeder cavity 54. The left-hand auger 74 is coaxially coupled to a drive shaft 75, both of which are driven for rotation by the drive motor 76. The left-hand auger seats a drive gear 80 thereon, where the drive gear 80 meshes with drive gear 82 supported on an idler shaft 84 coaxially coupled to the right-hand auger 72. The drive gear 80 meshes with drive gear 82 so that rotation of the left-hand auger in a first direction causes a rotation of the right-hand auger in a second direction, opposite to the first direction. Appropriate bearings and supports are also provided as will be apparent to those of ordinary skill in the art.

The dewatered materials are received from the hopper chute 86 through the top opening in the hopper section 56 of the feeder housing 52, into the cavity 54 of the feeder housing 52, and are driven by the twin augers 72, 74 into the pressure generating section 64, out through the outlet end 60 of the feeder housing 52, and into the narrowing preload chamber 66. The tunnel-like pressure generating section 64 provided at the outlet end of the feeder housing 52 acts to provide a pressure build-up at the outlet end of the feeder cavity 54, which improves the feed of the dewatered materials through the transition conduit 14 and suction housing 20 of the progressing cavity pump and into the progressing cavity pump elements 24, 28. Additionally, the narrowing preload conduit 66 also acts to provide a pressure build-up at the outlet end of the feeder cavity 54, which improves the feed of the dewatered materials through the transition conduit 14 and the suction housing 20 of the progressing cavity pump, and into the progressing cavity pump elements 24, 28.

Referring to FIG. 1, optionally, the system will also include a lubrication injection ring 87 positioned in the discharge section 18 to decrease the friction between the product and the discharge pipe wall. This, in turn, decreases the amount of head pressure that the progressing cavity pump 16 needs to develop. The decrease in head pressure allows a smaller pump to be used and also decreases the maintenance time/cost of the system and energy consumed by the system.

In the embodiment shown in FIG. 1, the elongated feeder housing 52 is positioned substantially parallel to the progressing cavity pump 16 and is supported over the progressing cavity pump elements 24, 28 by a frame 88. This configuration of the system provides a relatively small footprint for the system, which allows the system to be retrofit into the limited spaces available in municipal wastewater treatment facilities. In this configuration the dewatered materials must essentially traverse a C-turn path from the feeder 12, through the transition conduit 14, and into the suction housing 20.

Figure 4A:
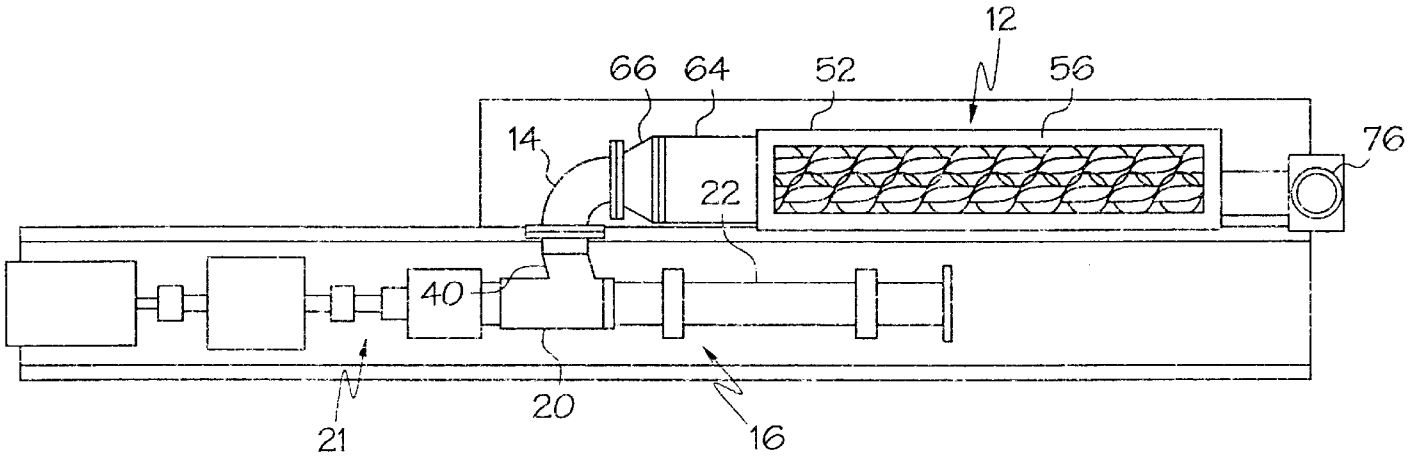
FIG. 4 is a top, schematic view of an alternative configuration of the present invention.
FIG. 4B is an elevational, side view of the configuration of FIG. 4A.
FIG. 4C is an elevational, end view of the configuration of FIGS. 4A and 4B.
Figure 4B:
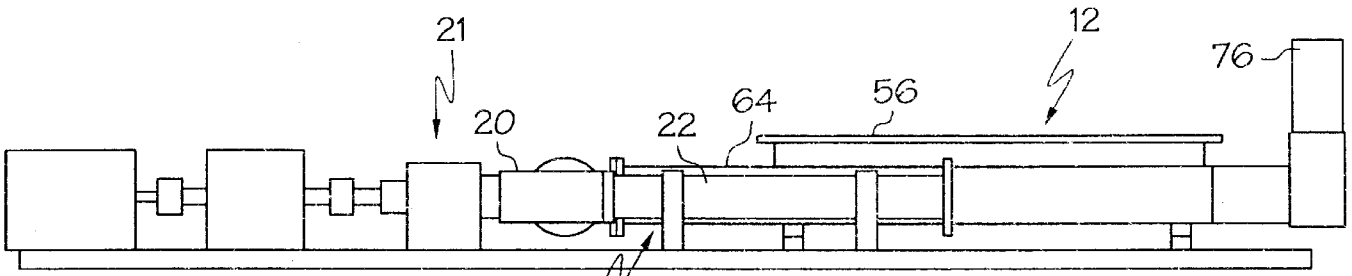
Figure 4C:
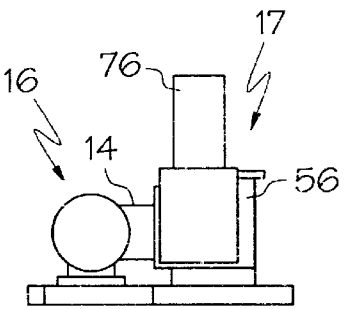

As shown in FIGS. 4A–4C, an alternate configuration for the present invention positions the elongated feeder 12 on a radial side of the elongated progressing cavity pump 16, approximate the discharge end of the progressing cavity pump. In this configuration the dewatered materials must essentially traverse a U-turn path from the feeder 12, through the transition conduit 14, and into the suction housing 20. The elongated feeder 12 and progressing cavity pump 16 are preferably aligned substantially parallel to each other. This configuration reduces the overall height of the system as compared to the configuration of FIG. 1, but increases the width of the system.

Figure 5A:
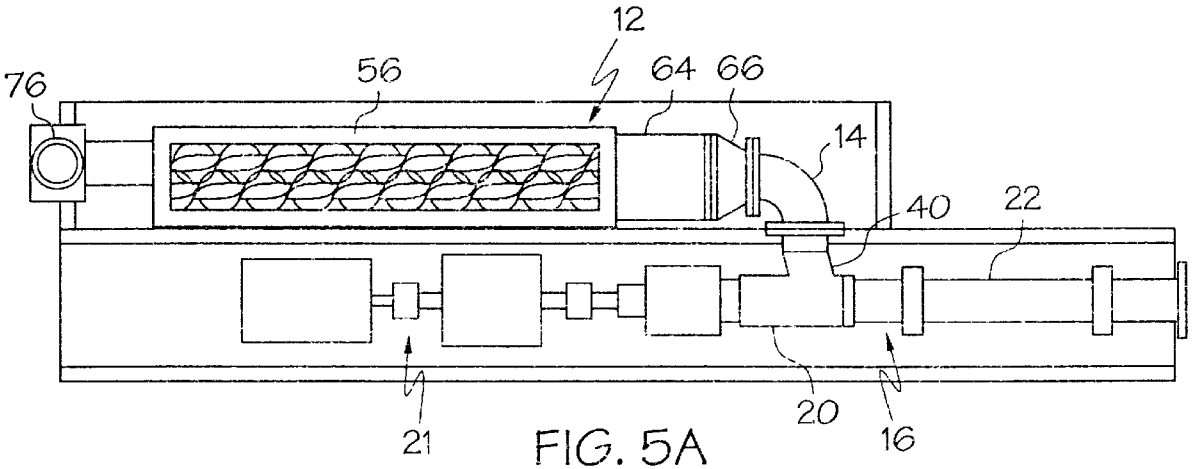
FIG. 5 is a top, schematic view of an alternative configuration of the present invention.
FIG. 5B is an elevational, side view of the configuration of FIG. 5A.
FIG. 5C is an elevational, end view of the configuration of FIGS. 5A and 5B.
Figure 5B:
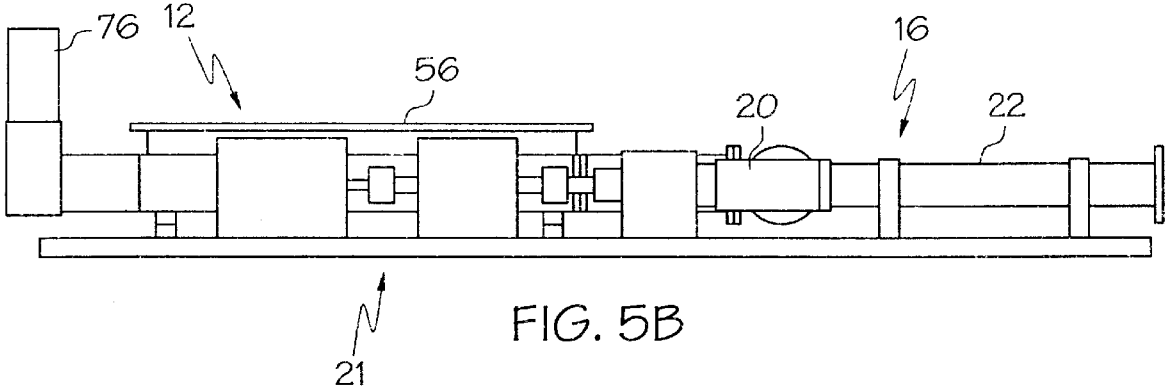
Figure 5C:
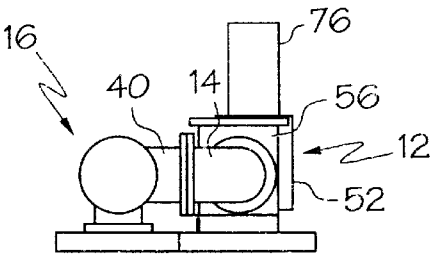

As shown in FIGS. 5A–5C, yet another alternate configuration of the system reverses the orientation of the feeder from FIGS. 4A–4C, placing the feeder substantially in alignment with the drive section 21 of the progressing cavity pump 16. This configuration has substantially the same width requirements as the configuration shown in FIGS. 4A–4C and also eliminates the U-turn path traversed by the materials in the transition conduit as experienced by the configurations of FIGS. 1 and 4A–4C.

Figure 6A:
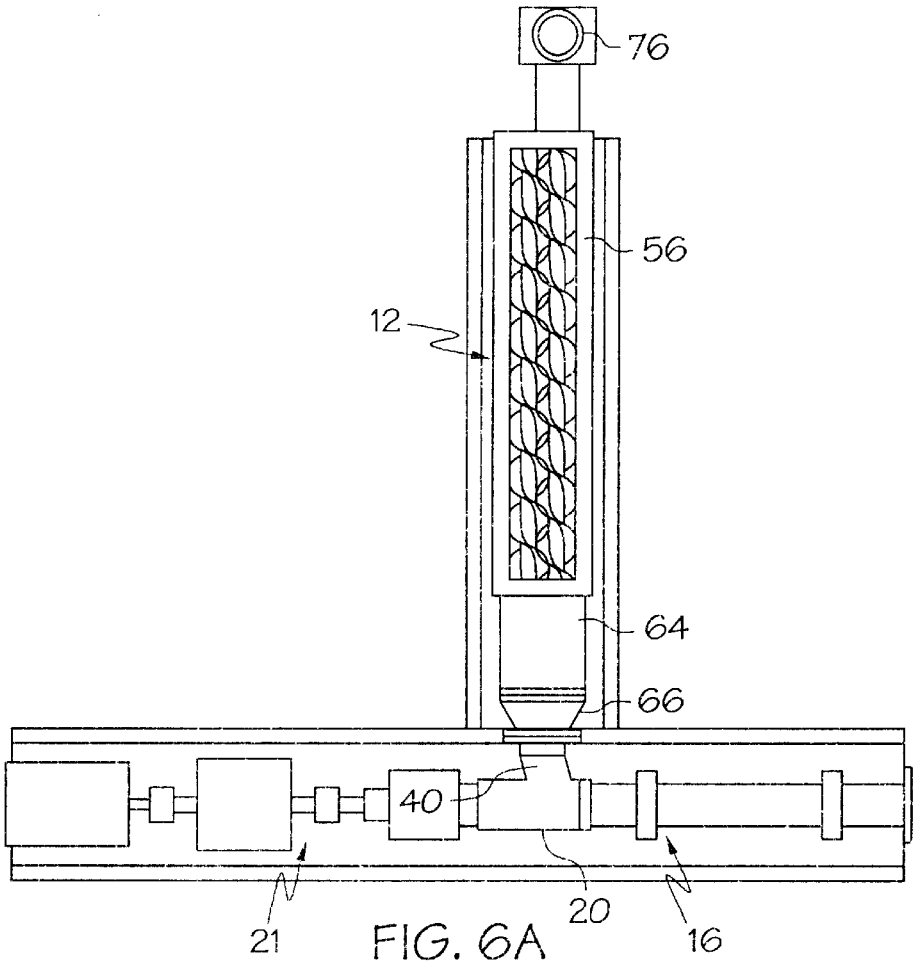
FIG. 6A is atop, schematic view of an alternative configuration of the present invention.
Figure 6B:
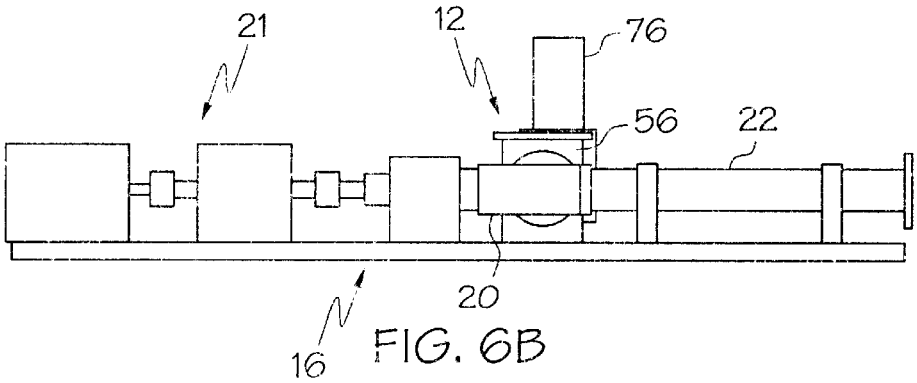
FIG. 6B is an elevational, side view of the configuration of FIG. 6A.
Figure 6C:
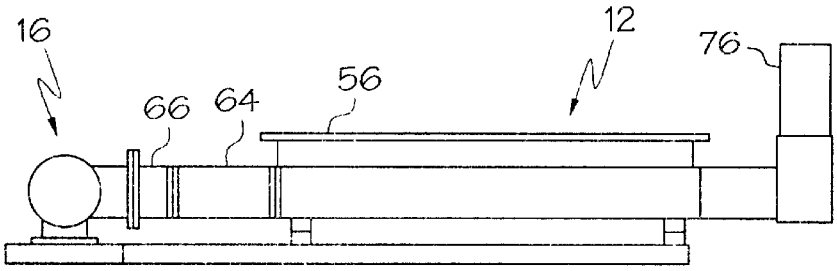
FIG. 6C is an elevational, end view of the configuration of FIGS. 6A and 6B.

FIGS. 6A–6C provide yet another alternate configuration of the present invention, where the longitudinal feeder housing 52 is positioned substantially perpendicular to the longitudinal progressing cavity pump 16. While this configuration has the widest footprint, it also has the best transition flow for the materials, since only one long-radius 90 degree turn (from the inlet conduit 40 to the suction housing 20) is required. Note that a transition conduit is not necessitated with this configuration.

Figure 7C:
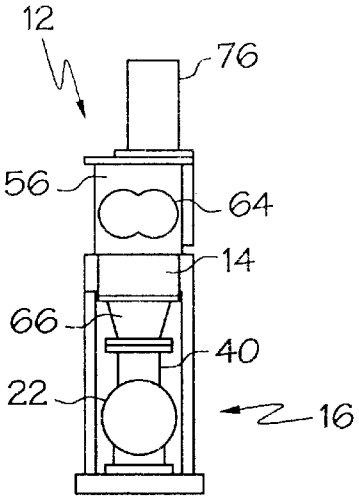
FIG. 7C is an elevational, end view of the configuration of FIGS. 7A and 7B.
Figure 7A:
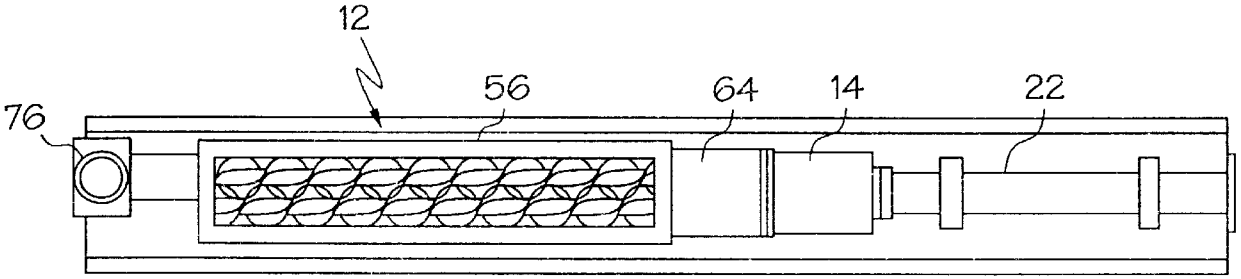
FIG. 7A is a top, schematic view of an alternative configuration of the present invention.
Figure 7B:
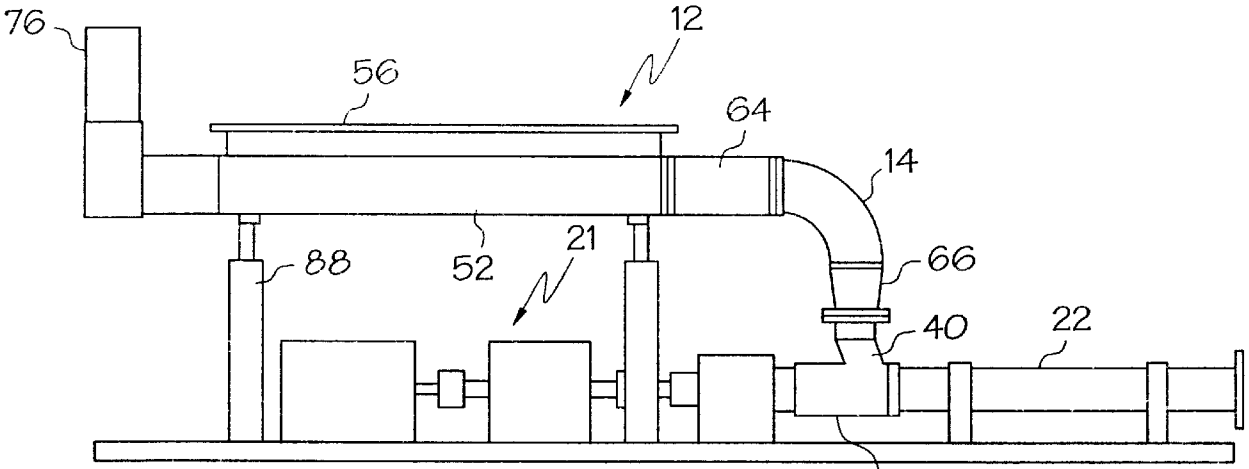
FIG. 7B is an elevational, side view of the configuration of FIG. 7A.

As shown in FIGS. 7A–7C, yet another alternative configuration of the present invention positions the feeder housing 52 on a platform 88 again; but in this configuration, it is positioned over the drive section 21 of the progressing cavity pump 16. While this configuration is the tallest and the longest, the flow only requires two long-radius 90 degree turns and is maintained in the same direction. Also note that with this configuration, the narrowing preload conduit 66 is positioned between the transition conduit 14 and the inlet conduit 40.

Figure 8:
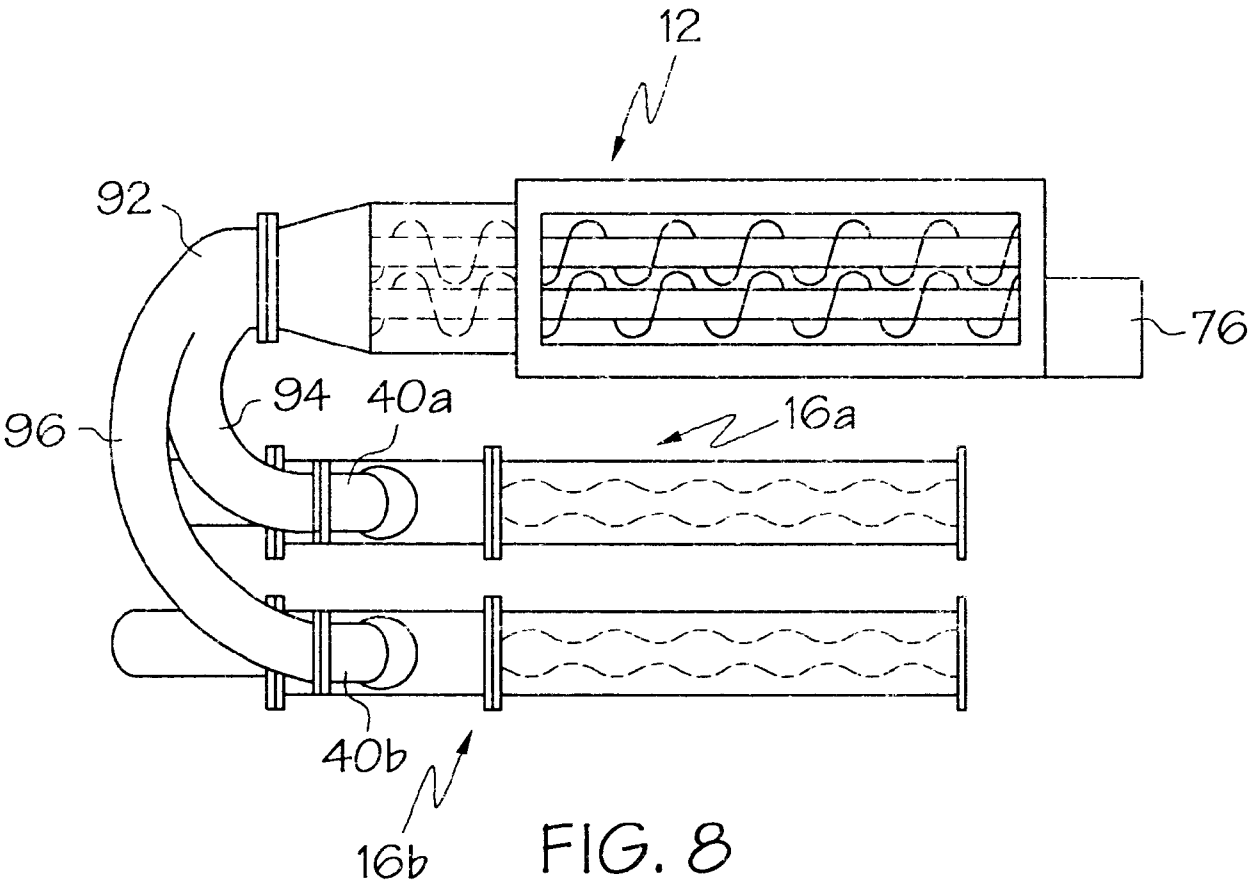
FIG. 8 is a top, schematic view of an alternative embodiment of the present invention.

As shown in FIG. 8, yet another embodiment of the present invention utilizes multiple progressing cavity pumps 16*a*, 16*b*, fed by a single twin-screw feeder 12 according to the present invention. This configuration requires a modified transition housing 92, which forks into a pair of inlet conduits 94, 96 coupled to inlet conduits 40*a* and 40*b*, respectively. With this configuration, the capacity of the twin-screw feeder is selected to supply the capacity of multiple pumps. While only two pumps are illustrated, it is within the scope of the invention to for the feeder 12 to feed several pumps. The purpose of this configuration is to provide controlled flow to more than one discharge point such as in a multiple hearth incinerator where several injection points around the cylindrically shaped furnace results in a controlled bum of the sludge. Other split-flow applications also exist, such as delivering sludge evenly along the length of a tractor trailer.

Figure 9:
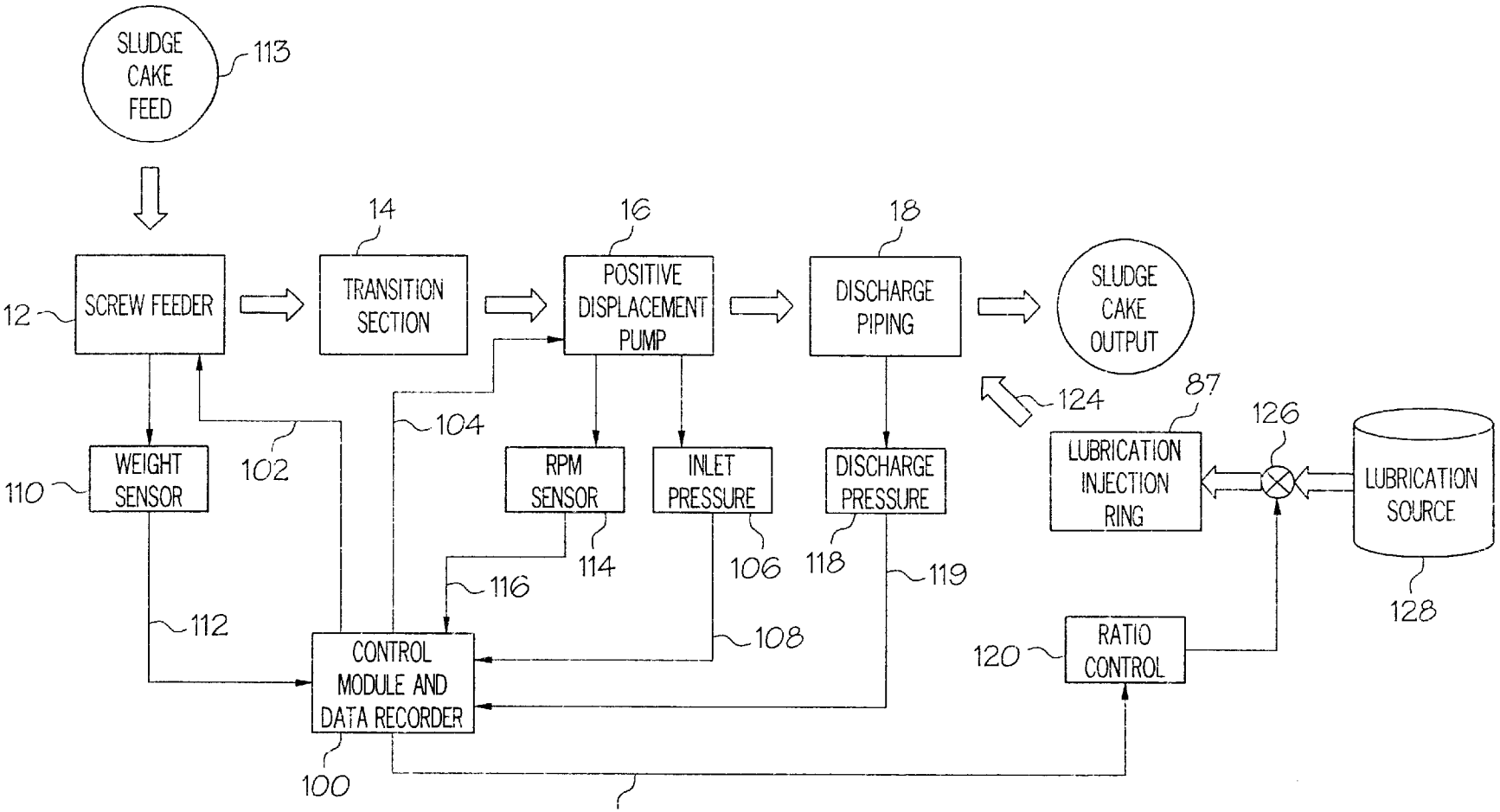

As shown in FIG. 9, a control module (and data recorder) 100 is provided for controlling the speed and operation of the screw feeder 12 and progressing cavity pump 16 through control/speed feedback signals 102, 104. A large diaphragm pressure sensor 106 positioned in the suction housing of the progressing cavity pump monitors inlet pressure to the pump (see also, FIG. 1). The sensor provides a pressure reading signal 108 to the control module. Using this pressure reading signal, the control module 100 will control the speed of the screw feeder 12, using feedback signal 102, to maintain optimal in-feed pressure (per set point and PID control). A weight sensor 110 is provided in the twin-screw feeder to provide a weight signal 112 to the control module. Through PID control, the control module 100 will adjust the speed of the pump 16, using feedback signal 104, to maintain a constant sludge level (per set point) in the feeder 12. By maintaining a constant sludge level in the feeder 12, the pump flow rate is matched to the rate of the belt press or centrifugal feed (both of which are designated by numeral 113) feeding the hopper chute 86 of the feeder 12. A tachometer sensor 114 on the pump drive registers the RPM and total quantity of pump revolutions for the production run, sending an RPM signal 116 to the control module 100. A discharge pressure sensor 118 registers the discharge pressure for consistency indications and transmits a discharge pressure signal 119 to the control module 100.

As one of ordinary skill in the art will recognize, all of such data (signals 108, 112, 114, 116 and 119) may recorded for later analysis and/or displayed in real-time through the control module 100.

If the system utilizes the optional lubrication injection ring 87 in the discharge piping 18, the control module 100 will control the ratio controller 120, via control signals 122, to control the amount of lubricant 124 injected by the lubrication injection ring 87 based upon the discharge pressure signal 119. The higher the discharge pressure, the more lubricant 124 will be injected, for example. The ratio controller 120 controls a valve 126, which is positioned between a lubrication source 128 and the lubrication injection ring 87.

The calibration of the present system is performed through selection of a calibration mode in the control module 100. Such calibrations can occur as often as desired. Most applications will utilize a single calibration at a specific interval such as one month. For optimal accuracy, the procedure would be to calibrate the system at the beginning of a production run and also at the end of the production run. After the system is started up, and is performing at a steady state of flow and pressure with a full discharge line, an operator can select the calibration mode. When the calibration mode has begun, the following steps will occur: (1) the control module 100 will register steady state inlet pressure 108, discharge pressure 119 and pump RPMs 116; (2) the pump 16 will be de-energized and the twin-screw feeder 12 hopper will be allowed to fill up to the highest level set point; (3) the infeed 113 to the feeder (i.e., the belt press or centrifuge) will then be paused and held off for the remainder of the calibration period; (4) the operator will take a sample of the sludge for a lab test of total solids and density; (5) the sludge weight ($W_0$) will be registered, and the calibration timer will be set to zero (to); (6) the pump 16 will be energized, the calibration timer is started and the pump control will be placed in calibration mode with the output set at the average steady state RPM; (7) the control module 100 will log and record inlet pressure 108, discharge pressure 119 and pump RPMs 116; and the inlet control module 100 will control the speed of the feeder 12, using feedback signal 102, to maintain the proper inlet pressure set point; (8) when low level in the feeder 12 is sensed, the pump 16 will be de-energized and the calibration timer ($t_1$) stopped, and further, the weight ($W_1$) will be registered and logged, as well as the total quantity of pump revolutions ($QTest_{rev}$); and (9) the operator will then take the system out of calibration control, restart the infeed 113 to the hopper (i.e., belt press, centrifuge), and restart the pump system 16.

The total calibration time is approximately 10 minutes. From this calibration, the control module will perform the following calculations:

$$\text{Mass Flow Rate}=(W_1-W_0)/(t_1-t_0) \quad \text{Eq. 1}$$

$$\text{Total Mass}=(\text{Mass Flow Rate})(\text{Total Rev}/QTest_{rev}) \quad \text{Eq. 2}$$

As soon as lab tests are known, the operator will input the total solids and density values. A density value is not required for mass determinations, but rather diagnostic parameters in determining predictive maintenance. The total solids value will indicate the actual sludge solids in mass pumped per unit time. This calculation is:

$$\text{Total Solids Pumped}=(\text{Mass Flow Rate})(\%\ \text{Solids}) \quad \text{Eq. 3}$$

As one of ordinary skill in the art will recognize, the above calibration calculations may be used with other types of positive displacement pump systems, in addition to progressing cavity pump systems.

While the present invention has been described in detail above, by reference to its preferred embodiments, it will be apparent to those of ordinary skill in the art that changes can be made without departing from the scope of the invention as defined in the following claims.

What is claimed is:

1. A progressing cavity pump system comprising:

an elongated progressing cavity pump having a suction housing, a discharge port, an elongated progressing cavity stator positioned between the suction housing and discharge port, and an elongated progressing cavity rotor positioned for rotation within the progressing cavity stator;

a feeder having a feeder housing, an inlet, an outlet at a longitudinal end of the feeder housing, and an auger mechanism positioned in the feeder housing for feeding material from the inlet to the outlet, the feeder housing being positioned radially apart from the progressing cavity pump; and a transfer conduit coupled between the outlet of the feeder and the suction housing of the progressing cavity pump.

2. The progressing cavity pump system of claim 1, wherein the feeder housing is elongated and extends substantially parallel to the progressing cavity pump.

3. The progressing cavity pump system of claim 2, wherein the feeder housing is mounted on a frame extending over the progressing cavity pump.

4. The progressing cavity pump system of claim 3, wherein the inlet of the feeder is an elongated opening extending into the top of the feeder housing, communicating with a hopper positioned above the opening.

5. The progressing cavity pump system of claim 1, wherein:

the transfer conduit includes an outlet segment directly coupled to the suction housing of the progressing cavity pump; and the outlet segment of the transfer conduit is angled at least partially away from the discharge port, thereby providing a substantially smooth transition for material being pumped from the transfer conduit and through the suction housing of the progressing cavity pump.

6. The progressing cavity pump system of claim 1, wherein:

the auger mechanism includes a pair of parallel, intermeshing augers rotating in opposite directions, the augers extending substantially an entire length of the feeder housing; and the inlet to the feeder housing is positioned in the top of the feeder housing and extends from a longitudinal end of the feeder housing opposite the outlet end to a point substantially distal from the outlet end, providing an extended tunnel section in the feeder.

7. The progressing cavity pump system of claim 6, wherein the tunnel section extends for at least approximately two pitch lengths of the augers.

8. The progressing cavity pump system of claim 6, wherein the tunnel section of the feeder housing is removably coupled to the remaining sections of the feeder housing, thereby allowing the tunnel section to be machined and/or reconditioned to precise tolerances.

9. The progressing cavity pump system of claim 6, further comprising a narrowing conduit positioned between the outlet of the feeder housing and the suction housing of the progressing cavity pump.

10. A progressing cavity pump comprising:

an elongated stator housing having a suction end and a discharge end;

an elongated progressing cavity stator mounted within the stator housing;

an elongated progressing cavity rotor mounted for rotation within the progressing cavity stator, the progressing cavity rotor having a suction end and a discharge end;

a suction housing coupled to the stator housing at the suction end of the stator housing, the suction housing including an inlet port;

an auger positioned in the suction housing, directly coupled to the suction end of the progressing cavity rotor, the auger including a forward longitudinal end approximate the progressing cavity rotor and a rear longitudinal end distal from the progressing cavity rotor; and a drive shaft extending into the suction housing having a forward longitudinal end and a rear longitudinal end, the forward longitudinal end of the drive shaft being coupled to the rear longitudinal end of the auger by a universal joint.

11. The progressing cavity pump of claim 10, wherein the inlet port opening is positioned in a radial side wall of the suction housing, the inlet port opening having a forward edge approximate the forward longitudinal end of the auger and a rear edge approximate the rear longitudinal end of the auger.

12. The progressing cavity pump of claim 11, wherein the universal joint is positioned behind the rear edge of the inlet port opening, thereby positioning the universal joint substantially out of the path of materials being transported through the inlet port opening and through the suction housing.

13. The progressing cavity pump of claim 10, wherein the auger is integral with the progressing cavity rotor.

14. The progressing cavity pump of claim 13, wherein:

the auger includes a shaft of a diameter, having a helical blade extending therefrom and threaded substantially along the length of the auger shaft; and the progressing cavity rotor has a diameter substantially equal to the diameter of the auger shaft;

whereby a substantially smooth transition is provided from the auger shaft to the rotor.

15. The progressing cavity pump of claim 10, further comprising an inlet conduit extending radially outward from the inlet port opening, the inlet conduit being angled at least partially rearward with respect to the auger, thereby providing a smooth transition of material from the inlet conduit and through the suction housing.

16. The progressing cavity pump of claim 15, further comprising a material feeder in fluid communication with the inlet conduit, the material feeder including a feeder housing, an inlet, an outlet at an end of the feeder housing, and an auger mechanism positioned in the feeder housing for feeding material from the feeder inlet to the feeder outlet.

17. The progressing cavity pump of claim 16, wherein the feeder housing is positioned radially apart from the suction housing.

18. The progressing cavity pump of claim 17, wherein the feeder housing is elongated and extends substantially parallel to the elongated stator housing.

19. The progressing cavity pump of claim 18 further comprising a support structure seating the feeder housing over top of at least a portion of one of the elongated stator housing, the suction housing and a motor housing mounted to the suction housing.

20. The progressing cavity pump of claim 16, wherein:

the auger mechanism of the feeder is positioned within an elongated cavity within the feeder housing and the feeder outlet is in fluid communication with an outlet end of the elongated cavity;

the auger mechanism of the feeder includes a pair of parallel, intermeshing augers positioned within the elongated cavity within the feeder housing and rotating in opposite directions, the augers extending substantially the entire length of the elongated cavity within the feeder housing; and the inlet to the feeder housing is positioned in the top of the feeder housing, radially adjacent to the auger mechanism, and extends from a longitudinal end of the elongated cavity within the feeder housing opposite the outlet end to a point substantially distal from the outlet end of the feeder cavity, providing an extended tunnel section within the feeder cavity, approximate the outlet of the feeder cavity.

21. The progressing cavity pump of claim 20, wherein the extended tunnel section extends for at least approximately two pitch lengths of the augers.

22. The progressing cavity pump of claim 20, wherein the extended tunnel section of the feeder housing is removably coupled to the remaining sections of the feeder housing, thereby allowing the extended tunnel section to be machined and/or reconditioned to precise tolerances.

23. The progressing cavity pump system of claim 20, further comprising a narrowing conduit positioned between the outlet of the feeder housing and inlet of the suction housing.

24. The progressing cavity pump of claim 10, further comprising a drive motor coupled to rear longitudinal end of the drive shaft and a drive motor housing mounted to the suction housing.

25. The progressing cavity pump of claim 24, wherein the drive shaft is a hollow drive shaft.

26. A progressing cavity pump system comprising:

a feeder mechanism, including, a feeder housing having an inlet, an outlet on an end of the feeder housing and an elongated cavity within the feeder housing, the feeder outlet being in fluid communication with the elongated cavity, and a pair of parallel, intermeshing augers positioned in the elongated cavity and rotating in opposite directions;

at least two progressing cavity pumps, each progressing cavity pump including a suction housing, an inlet in the suction housing, a discharge port, an elongated progressing cavity stator positioned between the suction housing and discharge port, and an elongated progressing cavity rotor positioned for rotation within the progressing cavity stator; and a transfer conduit coupled between the feeder outlet and the suction housing inlet of each of the progressing cavity pumps.

27. A method for transporting high viscosity materials comprising:

introducing the materials into a hopper;

depositing the materials from the hopper to a pair of intermeshing, counter-rotating augers in a feeder;

conveying the materials, by the pair of augers, to a pressure generating chamber;

generating a predetermined pressure increase in the pressure generating chamber;

transporting the materials from the pressure generating chamber to a suction port of a progressing cavity pump; and pumping the materials, by the progressing cavity pump, to a desired outlet.

28. The method of claim 27, wherein the conveying, transporting and pumping steps occur continuously, thereby, not allowing the material to stop moving between the feeder and the desired outlet.

29. The method of claim 28, wherein the transporting step includes the step of transporting the materials from the pressure generating chamber to suction ports of at least two progressing cavity pumps, and the pumping step is performed by the at least two progressing cavity pumps.

30. The method of claim 27, further including the step of positioning the feeder in a location radially set apart from the progressing cavity pump.

31. The method of claim 27, further comprising the steps of:

sensing the pressure in the progressing cavity pump; and controlling the speed of the augers according to the pressure sensed in the progressing cavity pump.

32. The method of claim 31, wherein the step of sensing the pressure in the progressing cavity pump involves the step of sensing the pressure in the suction housing of the progressing cavity pump.

33. The method of claim 32, wherein the augers and the progressing cavity pump are driven by respective independent drives.

34. The method of claim 27, wherein the suction housing of the progressing cavity pump includes an auger positioned therein, integrally coupled to a helical rotor of the progressing cavity pump.

35. A method for transporting high viscosity materials comprising the steps of:

transporting the materials from a feeder to a suction port of a progressing cavity pump, the feeder having a feeder cavity and a feed mechanism within the feeder cavity;

pumping the materials, by the progressing cavity pump, to a discharge outlet;

sensing an amount of material in the feeder cavity; and controlling the speed of the progressing cavity pump according to the amount of material sensed in the feeder cavity.

36. The method of claim 35, wherein the step of sensing the amount of material in the feeder cavity includes the step of sensing the approximate weight of the material in the feeder cavity.

37. The method of claim 35, further comprising the steps of:

sensing the pressure of the material in a material path positioned between the feeder and an inlet to progressing cavity rotor and stator elements of the progressing cavity pump; and controlling the speed of the feed mechanism according to the pressure sensed in the material path.

38. The method of claim 37, wherein the step of sensing the pressure of the material in a material path positioned between the feeder and an inlet to progressing cavity rotor and stator elements of the progressing cavity pump, involves the step of sensing the pressure of material in the progressing cavity pump.

39. The method of claim 38, wherein the step of sensing pressure of material in the progressing cavity pump includes the step of sensing pressure in a suction housing of the progressing cavity pump.

40. The method of claim 39, further including the step of feeding material in the suction housing of the progressing cavity pump to the progressing cavity rotor and stator elements by an auger positioned in the suction housing and integral with the progressing cavity pump rotor.

41. A method for calibrating a positive displacement pump system, comprising the steps of:

depositing an amount of materials in a feeder coupled to and feeding a positive displacement pump system;

sensing the approximate initial amount of materials present in the feeder at an intial time;

operating the feeder and positive displacement pump for a calibration time;

sensing the approximate remaining amount of materials present in the feeder after the calibration time; and calculating a mass flow rate for the system based, at least in part, on the difference between the remaining amount and initial amount divided by the calibration time.

42. The method of claim 41, wherein the positive displacement pump includes a pump rotor, and the method further comprises the steps of:

recording the number of pump rotor revolutions occurring during the calibration time;

calculating a total mass transported by the system during a certain time period based, at least in part, on a multiplication of the mass flow rate and the total revolutions of the pump rotor during the certain time period divided by the number of pump rotor revolutions recorded during the calibration time.

43. The method of claim 41 further comprising the steps of:

determining the approximate percentage of solids in the materials being pumped; and calculating the total solids pumped based, at least in part, on the multiplication of the mass flow rate and the approximate percentage of solids in the materials being pumped.

44. The method of claim 41, wherein the steps of sensing the approximate initial and remaining amounts of materials in the feeder include the steps of sensing the weight of the materials in the feeder at the initial time and after the calibration time, respectively.

45. The method of claim 41, wherein the positive displacement pump is a progressing cavity pump having progressing cavity rotor and stator elements, and the method further includes the steps of, during the calibration time:

operating the progressing cavity pump at a steady-state RPM;

sensing a pressure of the materials being transported through the system at a point between the feeder and the progressing cavity rotor and stator elements; and controlling the speed of the feeder responsive to the pressure sensed between the feeder and the progressing cavity rotor and stator elements.

46. The method of claim 45, wherein the controlling step includes the step of controlling the speed of the feeder, responsive to the pressure sensed between the feeder and the progressing cavity rotor and stator elements, to maintain a predetermined pressure at a point between the feeder and the progressing cavity rotor and stator elements.

47. The method of claim 46, wherein the point between the feeder and progressing cavity rotor and stator elements is approximate an inlet to the progressing cavity rotor and stator elements.

* * * * *

UNITED STATES PATENT AND TRADEMARK OFFICE

CERTIFICATE OF CORRECTION

PATENT NO. : 6,491,501 B1
DATED : December 10, 2002
INVENTOR(S) : Alan G. Wild et al.

It is certified that error appears in the above-identified patent and that said Letters Patent is hereby corrected as shown below:

Column 18,
Line 25, insert the following claims 48-54:

48. The progressing cavity pump system of claim 1 wherein at least part of said auger mechanism is closely received inside at least part of said feeder housing.

49. The progressing cavity pump system of claim 1 wherein said feeder housing includes a pressure generating section which closely receives at least a portion of said auger mechanism therein.

50. The progressing cavity pump system of claim 49 wherein said pressure generating section generally completely radially encloses said portion of said auger mechanism received therein.

51. The progressing cavity pump system of claim 50 wherein said pressure generating section has a length of at least about two pitch lengths of said auger mechanism.

52. The progressing cavity pump system of claim 49 wherein said feeder housing includes an open section wherein least a portion of said auger mechanism is exposed.

53. The progressing cavity pump system of claim 49 wherein said feeder housing includes a narrowing conduit in fluid communication with said pressure generating section in a downstream direction.

UNITED STATES PATENT AND TRADEMARK OFFICE

CERTIFICATE OF CORRECTION

PATENT NO. : 6,491,501 B1
DATED : December 10, 2002
INVENTOR(S) : Alan G. Wild et al.

It is certified that error appears in the above-identified patent and that said Letters Patent is hereby corrected as shown below:

54. The progressing cavity pump system of claim 1 wherein said auger mechanism includes a pair of generally parallel, intermeshing augers rotatable in opposite directions.

Signed and Sealed this

Eighth Day of April, 2003

JAMES E. ROGAN
*Director of the United States Patent and Trademark Office*